US007640678B2

(12) United States Patent
Lee et al.

(10) Patent No.: US 7,640,678 B2
(45) Date of Patent: Jan. 5, 2010

(54) LAUNDRY DRYER AND IMPURITY ENTRY PREVENTING STRUCTURE FOR THE SAME

(75) Inventors: Soon Jo Lee, Changwon-si (KR); Hwan Joo Myung, Suwon-si (KR); Hung Myong Cho, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 362 days.

(21) Appl. No.: 11/390,308

(22) Filed: Mar. 28, 2006

(65) Prior Publication Data

US 2006/0230630 A1 Oct. 19, 2006

(30) Foreign Application Priority Data

Mar. 31, 2005 (KR) ..... 10-2005-0026927
Mar. 31, 2005 (KR) ..... 10-2005-0026928
Mar. 31, 2005 (KR) ..... 10-2005-0026929

(51) Int. Cl.
*F26B 11/02* (2006.01)
*F26B 21/04* (2006.01)

(52) U.S. Cl. ..... 34/601; 34/604; 34/607; 34/79; 34/82

(58) Field of Classification Search ..... 34/72, 34/79, 82, 595, 603, 605, 139, 601, 604, 34/607

See application file for complete search history.

(56) References Cited

U.S. PATENT DOCUMENTS 2,509,300 A * 5/1950 Hendrickson ..... 34/82
3,959,891 A * 6/1976 Burkall ..... 34/82

FOREIGN PATENT DOCUMENTS

DE 91 04 967.9 12/1991
DE 196 44 400 A1 4/1998

* cited by examiner

*Primary Examiner*—Jiping Lu
(74) *Attorney, Agent, or Firm*—KED & Associates, LLP

(57) ABSTRACT

Provided is a laundry dryer. The laundry dryer includes a drying drum for inserting laundry in, a base, and a cabinet enclosing the drying drum and the base. The base includes an outside air intake port that suctions indoor air, an air passage for moist air from the drying drum to pass through, and an impurity descending slot recessed a predetermined depth at a front of the outside air intake port for impurities to fall into.

9 Claims, 10 Drawing Sheets

LAUNDRY DRYER AND IMPURITY ENTRY PREVENTING STRUCTURE FOR THE SAME

BACKGROUND OF THE INVENTION

1. Field of the Invention

The present invention relates to a dryer, and more particularly, to a laundry dryer with a structure for preventing impurities such as lint from entering the drying drum together with outside air.

2. Description of the Related Art

A drum dryer is a home appliance that dries laundry by circulating hot, dry air within a drying drum to dry laundry inserted therein.

Drum dryers are divided into condenser dryers that circulate air between the drying drum and a heater to dry laundry inside the drum, and vented dryers that direct air heated by a heater into the drying drum to dry laundry, after which the air is exhausted from the drying drum to the outside.

In further detail, in a vented dryer, air that has been heated while passing through a heater flows into the drum, and then leaves the drum by passing through a lint filter installed at the front of the drum, removing it of lint. The air that passes through the lint filter then flows through an exhaust assembly formed at the bottom of the dryer, to be exhausted to the outside.

In a vented dryer, air from outside the dryer enters the drying drum through an intake, and after the air in the drying drum dries the laundry therein, it is exhausted to the outside. However, in the related art, where air is drawn into the drum from outside the dryer, there is a need to prevent dust and lint from entering the drum. In other words, impurities in the outside air that enters the drum through the intake can contaminate laundry in the drum.

SUMMARY OF THE INVENTION

Accordingly, the present invention is directed to a laundry dryer that substantially obviates one or more problems due to limitations and disadvantages of the related art.

An object of the present invention is to provide a laundry dryer with an impurity entry preventing structure that blocks the entry of impurities such as lint and dust into the drying drum through an outside air intake connected to the rear of the drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a laundry dryer including: a drying drum for inserting laundry in; a base including an outside air intake port for suctioning indoor air, an air passage for moist air from the drying drum to pass through, and an impurity descending slot recessed a predetermined depth at a front of the outside air intake port for impurities to fall into; and a cabinet enclosing the drying drum and the base.

In another aspect of the present invention, there is provided a laundry dryer including: a cabinet; a drying drum disposed within the cabinet; a base disposed within the cabinet, and including: a lower base having an outside air intake port for suctioning indoor air and an impurity separating slot for separating impurities from air entering the outside air intake port; and an upper base coupled at a top of the lower base; and a lint cap formed in the outside air intake port, for filtering impurities in a second stage that have not been separated by the impurity separating slot.

In yet another aspect of the present invention, there is provided a laundry dryer including: a cabinet; a drying drum disposed within the cabinet; a lower base installed below the drying drum, and including an outside air intake port for suctioning indoor air, a lint entry preventing member permanently or detachably installed to the outside air intake port, and an air passage for guiding a flow of moist air from the drying drum; and an upper base coupled at a top of the lower base, for covering the air passage.

In a further aspect of the present invention, there is provided a laundry dryer including: a drying drum; a lower base installed below the drying drum, and including an outside air intake port for suctioning indoor air and a recessed portion for preventing comparatively heavy impurities contained in the indoor air from passing through the outside air intake port and accumulating the impurities; and an upper base coupled at a top of the lower base; and a lint blocking member permanently or detachably coupled to the outside air intake port, for preventing impurities from entering the drying drum through the outside air intake port.

In the laundry dryer having the above impurity entry preventing structure according to the present invention, the entry of impurities such as lint or dust (along with outer air) into the drying drum during a drying cycle can be prevented.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
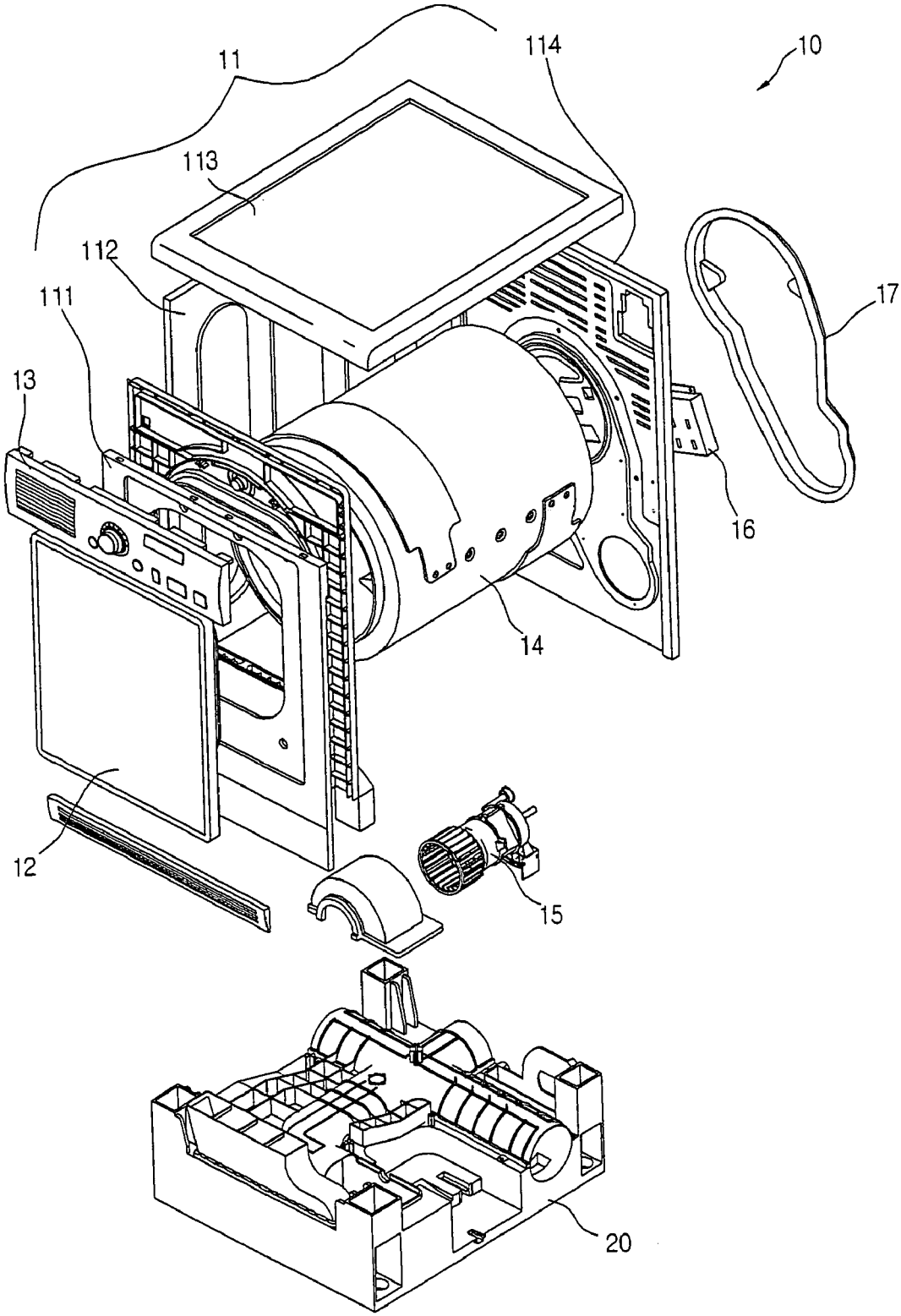
FIG. 1 is an exploded perspective view of a laundry dryer according to the present invention.

FIG. 1 is an exploded perspective view of a laundry dryer according to the present invention.

Referring to FIG. 1, a dryer 10 with a passage structure according to the present invention includes a drying drum 14 for putting laundry into, a cabinet 11 installed outside the drying drum 14 for protecting the drying drum 14, a base 20 installed below the drying drum 14 and having an air exhaust duct formed within, and a motor 15 mounted on the upper portion of the base 20 for rotating the drying drum 14.

In more detail, the cabinet 11 includes a front cover 111 for supporting the front portion of the drying drum 14, a side cover 112 installed on the side of the drying drum 14, and a back cover 114 supporting the rear of the drying drum 14, and a top cover 113 at a top of the drum 14.

The dryer 10 also includes a door 12 pivotably installed at the front of the front cover 111 to open and close the opening at the front of the drying drum 14 for inserting and extracting laundry, a control panel 13 installed above the door 12 and having buttons for inputting dryer settings and operation, a drying duct 17 installed at the rear of the back cover 114 to guide outside air into the drying drum, and a heater 16 installed inside the drying duct 17 to heat the outside air drawn in.

The operation of the above-described dryer 10 will now be explained.

First, a user opens the door 12 and inserts laundry into the drying drum 14. Then, using the setting portion on the control panel 13, the user inputs dryer settings. When the start button is pressed, the motor 15 and the heater 16 installed inside the drying duct 17 operate. A suctioning blower installed below the base 20 rotates to suction outside air into the dryer 10.

In more detail, outside air enters the drying duct 17 through an outside air intake port (described later) formed at the bottom of the back cover 114, and is heated while passing through the drying duct 17. The heated air enters the drying drum 14 through a rear wall of the drying drum 14. The heated air that enters the drying drum 14 absorbs moisture imbued in laundry and becomes hot, moist air. The air that becomes hot and moist leaves the drying drum 14 by passing through a lint filter (not shown) formed on the front cover 111, shedding impurities such as lint in the process.

The air that passes through the lint filter flows along the exhaust passage (described below) installed on the base 20, and is ultimately exhausted out from the dryer 10. Here, the base 20 forms a passage within for air to be exhausted, and exhaust ports are formed on the sides and rear of the base 20. One of the exhaust ports may be open while the remaining ports may be sealed. The air passage formed within the base 20 will be described in further detail below with reference to the diagrams.

Figure 2:
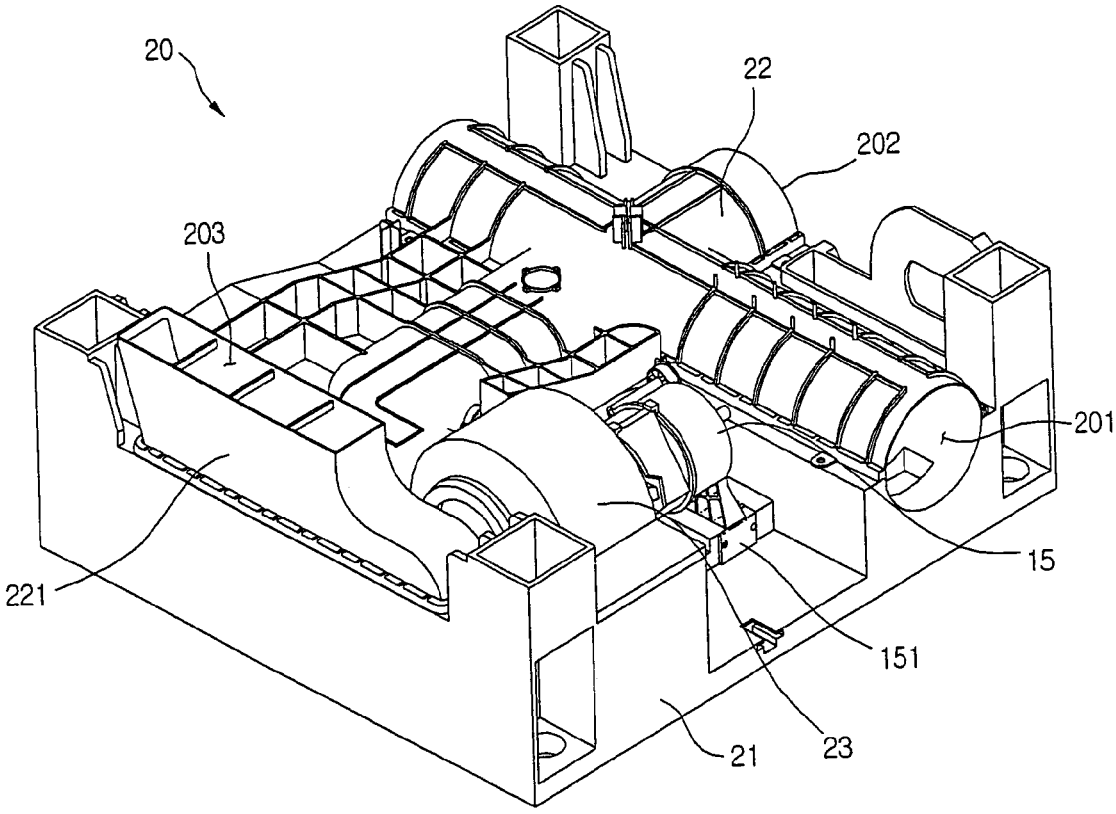
FIG. 2 is a perspective view of a base installed in a dryer according to the present invention.

FIG. 2 is a perspective view of a base installed in a dryer according to the present invention.

Referring to FIG. 2, the base 20 of the dryer according to the present invention includes a lower base 21 and an upper base 22 mounted on top of the lower base 21.

In detail, the motor 15 is mounted on top of the lower base 21, and the passage for exhausting air is formed within the upper part of the lower base 21. The upper base 22 covers the air passage, so that the exhausting air is not dispelled but directed to flow in a predetermined direction.

In further detail, the lower base 21 and the upper base 22 are respectively plastic injection molded and coupled together in one piece by means of fasteners. However, the manufacturing method of the base 20 is not limited thereto, and may include being formed in a single piece. A drum connecting passage 203 is formed at the front upper portion of the base 20, and a side exhaust port 201 is formed at the side and a rear exhaust port 202 is formed at the rear of the base 20. The motor 15 is mounted to one side on top of the base 20, and a blower is connected to the rotating motor shaft to suction air from inside the drum. The blower is protected by a blower cover 23. Here, the blower is installed at the front of the motor 15, as shown in FIG. 1. Moreover, a suctioning blower (installed at the rear of the base 20 and not depicted in FIG. 2) is attached to and operates by means of a separate motor.

In the above-described structure, the hot, moist discharged from the front of the drying drum 14 enters the drum connecting passage 203 and is exhausted back to the outside through the side exhaust port 201 and/or the rear exhaust port 202. Below, a detailed description of the air passages formed within the base 20 will be given, with reference to the diagrams.

Figure 3:
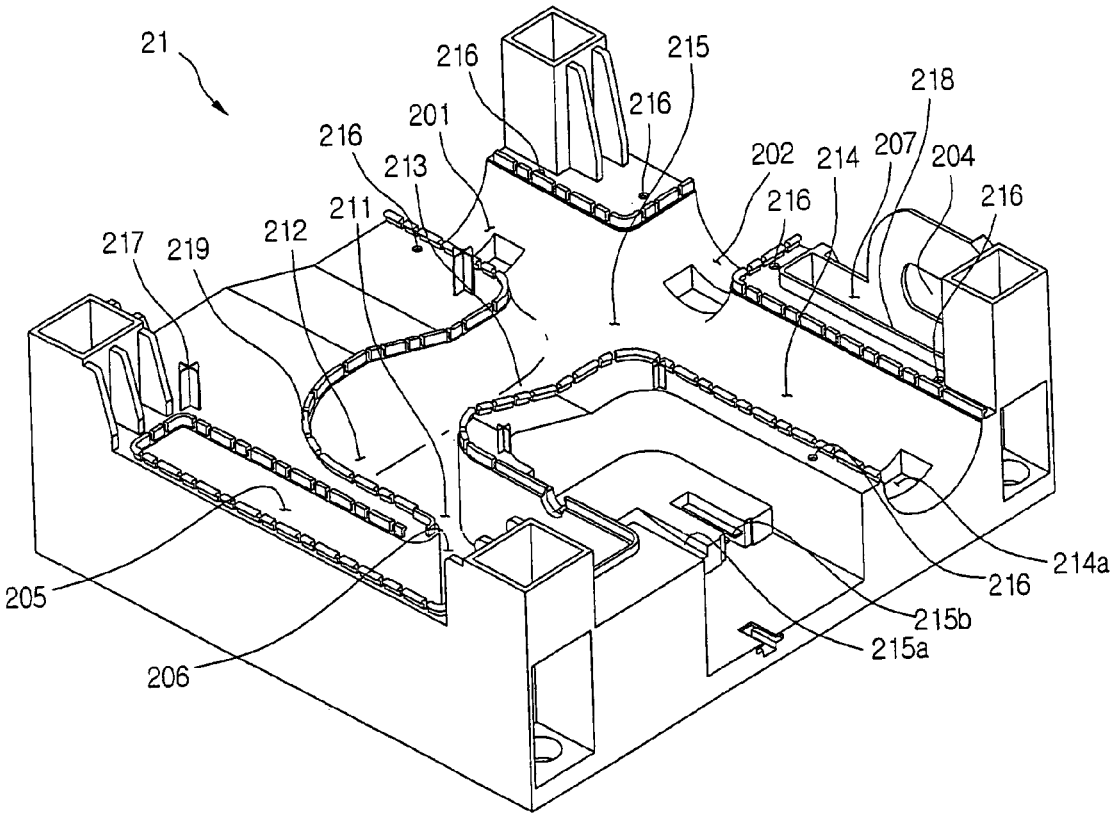
FIG. 3 is a perspective view of a lower base according to the present invention.

FIG. 3 is a perspective view of a lower base according to the present invention.

Referring to FIG. 3, the base 20 according to the present invention, as described above, includes a lower base 21 and an upper base 22 mounted on top of the lower base 21.

In detail, an air passage, through which air is exhausted from the drying drum 14, is formed in the lower base. A complete air passage is formed by covering the bottom half of the air passage with the upper base 22.

In more detail, a drum air descending passage 205, for the air passing from the drying drum 14 to descend, is formed at the front of the lower base 21. A blower entrance 206 is formed on one side of the drum air descending passage 205 for the descending air to be suctioned toward the blower. A blower compartment 211 is formed for mounting the blower at the blower entrance 206. An expanded passage portion 212 that bends at a predetermined angle and expands in diameter is connected to an end of the blower compartment 211. A main passage 213 that extends to the rear end of the base lower unit 21 is connected at the end of the expanded passage portion 212.

A sub passage 214 is formed to intersect with the main passage 213, forming the side exhaust ports 201 at either side of the lower base 21. A condensation pan **214*a* is respectively formed a predetermined depth into the floors at the rear exhaust port 202 and side exhaust ports 201, to collect condensing moisture from the exhausting air. A passage intersection 215 of the main passage 213 and the sub passage 214 is biased toward the rear of the lower base 21 from its center. That is, the sub passage 214 is closer to the rear of the lower base 21** than its front.

At least one upper base guiding protrusion 217 is formed on the top surface of the lower base 21, in order to guide the mounting position of the upper base 22 over the lower base 21. A fastening hook 219 is formed to protrude a predetermined height from along the perimeters of the main and sub passages 213 and 214, in order to tightly couple the upper base 22 to the lower base 21. Also, a plurality of fastening holes 216 are formed in the upper surface of the lower base 21, so that a fastening member (for fastening the upper base 22) can insert through the fastening hole 216. Specifically, the fastening holes 216 are formed symmetrically at the edges on either sides of the sub and main passages 214 and 213.

An outside air intake port 204 is formed at the rear of the lower base 21, to allow outside air to pass through the drying duct 17 into the drying drum. A lint entry preventing slot 207, or impurity descending slot 207, for collecting impurities such as lint in the outside air suctioned through the outside air intake port 204, is recessed a predetermined depth at the front of the outside air intake port 204. An intake blower for suctioning outside air is installed to the outside of the outside air intake port 204. Here, the outside air suctioned through the outside air intake port 204 is air within the cabinet 11 of the dryer 10. A lint entry preventing ledge 218 is formed to protrude from around the perimeter of the lint entry preventing slot 207. A detailed description of the lint entry preventing structure will be given below with reference to the drawings.

A motor mount 215*a* for mounting the motor 15 is formed in the space between the blower compartment 211 and the sub passage 214, where a motor supporting insert slot 215*b* is formed for supporting a motor supporter (not shown).

In the above structure, the hot, moist air that descends through the drum air descending passage 205 flows through the blower entrance 206 into the blower compartment 211. The air that enters the blower compartment 211 flows through the expanded passage portion 212 to the main passage 213. The air that flows to the main passage 213 branches at the passage intersection 215 and flows through at least one of the side exhaust ports 201 and/or the rear exhaust port 202 to the outside.

Here, a portion of the two side exhaust ports 201 and the rear exhaust port 202 may be sealed with caps. For example, if the dryer 10 is installed in a corner, one of the side exhaust ports 201 and the rear exhaust port 202 may sealed with caps, with only the remaining side exhaust port 201 opened. That is to say that caps can be used to selectively seal the exhaust ports, as mandated by the installed location of the dryer 10.

The air that flows toward the sealed exhaust ports during the circulation through the passages condenses, and the condensed water accumulates in the condensation pans 214*a*. Also, even when all the exhaust ports 201 and 202 are open, air that flows through the passages condenses, whereupon the condensed water accumulates in the condensation pans 214*a*.

Figure 4:
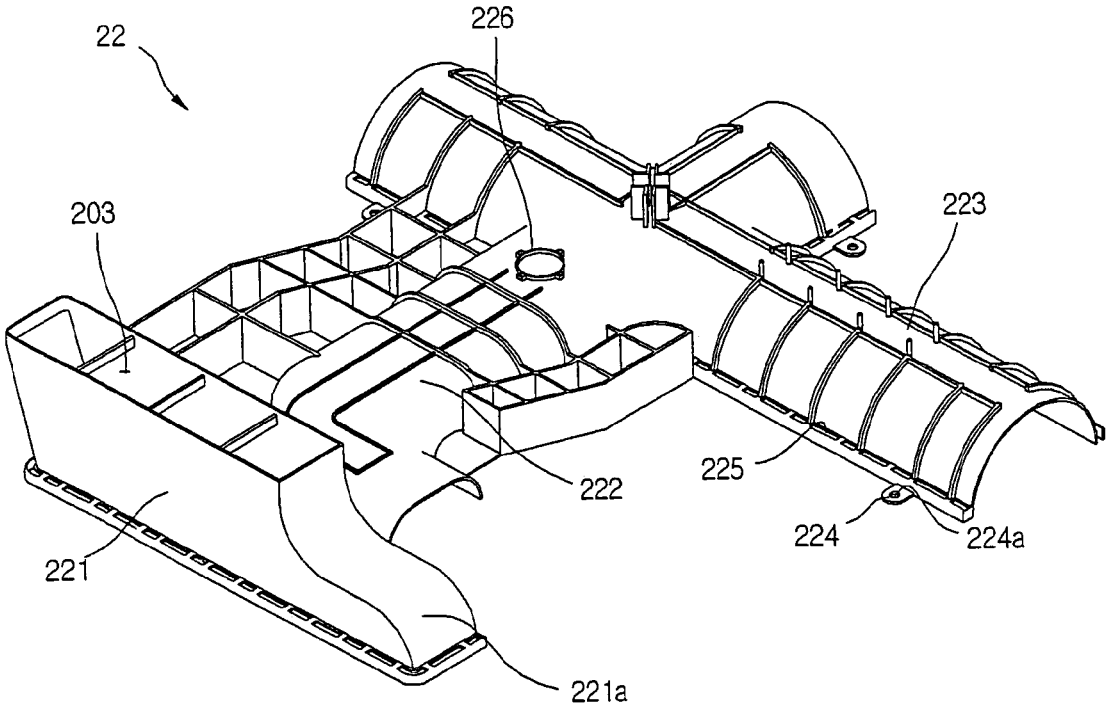
FIG. 4 is a perspective view of an upper base according to the present invention.
Figure 5:
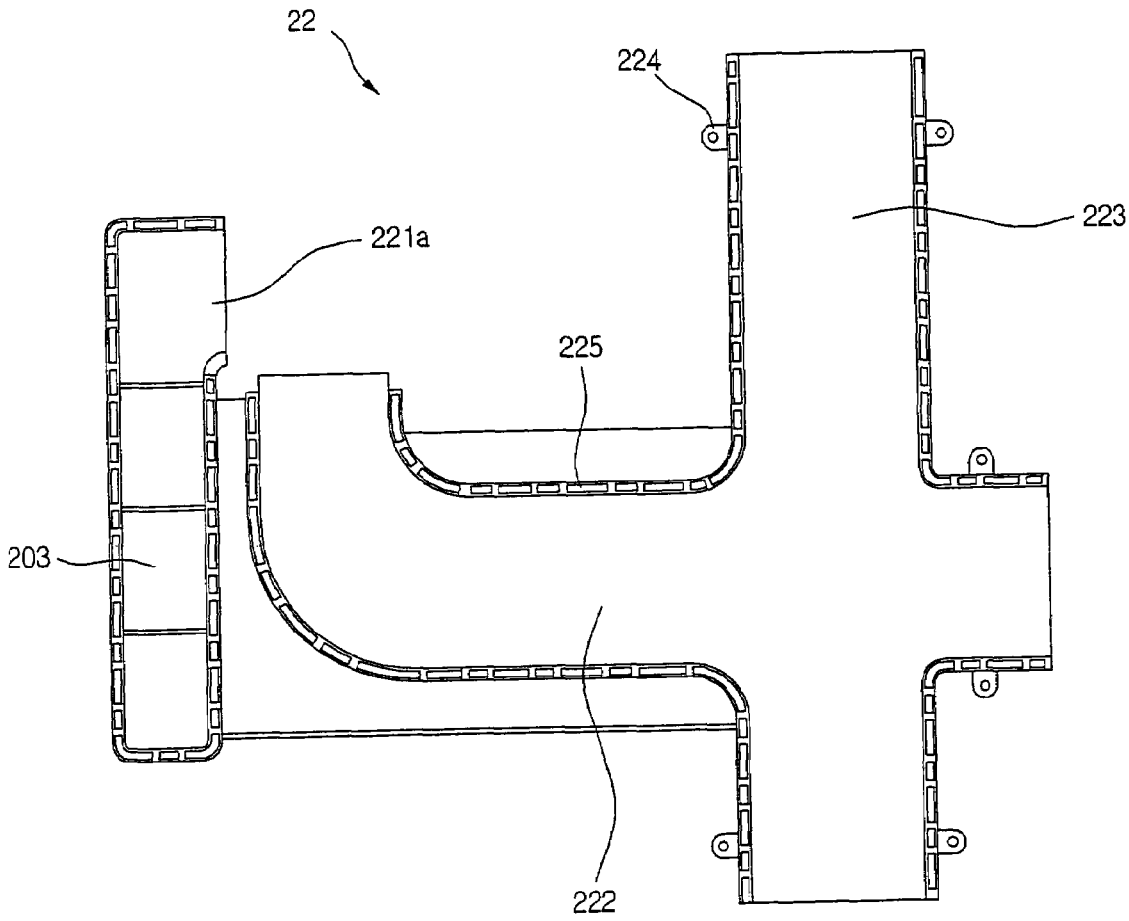
FIG. 5 is a plan view of the bottom of the upper base in FIG. 4.

FIG. 4 is a perspective view of an upper base according to the present invention, and FIG. 5 is a plan view of the bottom of the upper base in FIG. 4.

Referring to FIGS. 4 and 5, the upper base 22 according to the present invention, as described above, is mounted on top of the lower base 21.

Specifically, the upper base 22 is formed in a shape corresponding to that of the lower base 21 in terms of the passages, in order to seal the upper portion of the passages. A drum connecting passage 203 is formed at the front of the upper base 22, to provide an entrance for hot, moist air exiting the drying drum 14 toward the passages.

In more detail, the drum connecting passage 203 extends a predetermined distance upward from the top of the upper base 22 to form the interior of a drum connecting duct 221. A blower connecting portion 221*a* is formed to extend from the side of the drum connecting duct 221, so that air passes through the drum connecting passage 203 and flows into the blower entrance 206 formed in the lower base 21.

A main passage cover 222 and a sub passage cover 223 are formed on the upper base 22 to cover the expanded passage portion 212, the main passage 213, and the sub passage 214 formed in the lower base 21. The main passage cover 222 and the sub passage cover 223 also intersect with each other. A humidity sensor mount 226 is formed in a portion of the main passage cover 222 for installing a humidity sensor therein, in order to detect the level of humidity of air flowing through the main passage 213.

Hook insert holes 225 are formed along the lower perimeter of the main passage cover 222 and the sub passage cover 223, so that the fastening hooks 219 separated from one another by a predetermined distance on the lower base 21 can insert into the hook insert holes 225. A fastening tab 224, for tightly coupling the upper base 22 on the lower base 21, is formed respectively on either side at both ends of the sub passage cover 223 and on either side of the main passage cover 222. Specifically, a fastening hole 224*a* is formed in each fastening tab 224, so that a fastening member inserted through the fastening hole 224*a* inserts into the fastening hole 216 formed in the lower base 21. That is, the fastening member tightens the coupling of the upper base 22 to the lower base 21, so that no gaps are formed between the base upper and lower portions 22 and 21. In this way, the size of gaps formed between the base upper and lower portions 22 and 21 may be minimized, preventing leakage of air flowing within the passages and the possibility of it re-entering through the outside air intake port 204. In other words, the air flowing through the inside of the passages is prevented from leaking into the interior space of the cabinet 11 holding the drying drum 14 and being suctioned into the outside air intake port 204.

In the above structure, the hot, moist air that exits the drying drum 14 passes through the drum connecting passage 203 and descends to the drum air descending passage 205. The air that descends to the drum air descending passage 205 flows to the blower entrance 206. The air that descends to the drum connecting passage 203 flows along the blower connecting portion 221*a* and into the blower entrance 206. The air that enters the blower entrance 206 moves through the expanded passage portion 212, the main passage 213, and the sub passages 214. The air that flows through the main and sub passages 213 and 214 condenses and is exhausted to the outside through the rear exhaust port 202 and/or the side exhaust port(s) 201.

Figure 6:
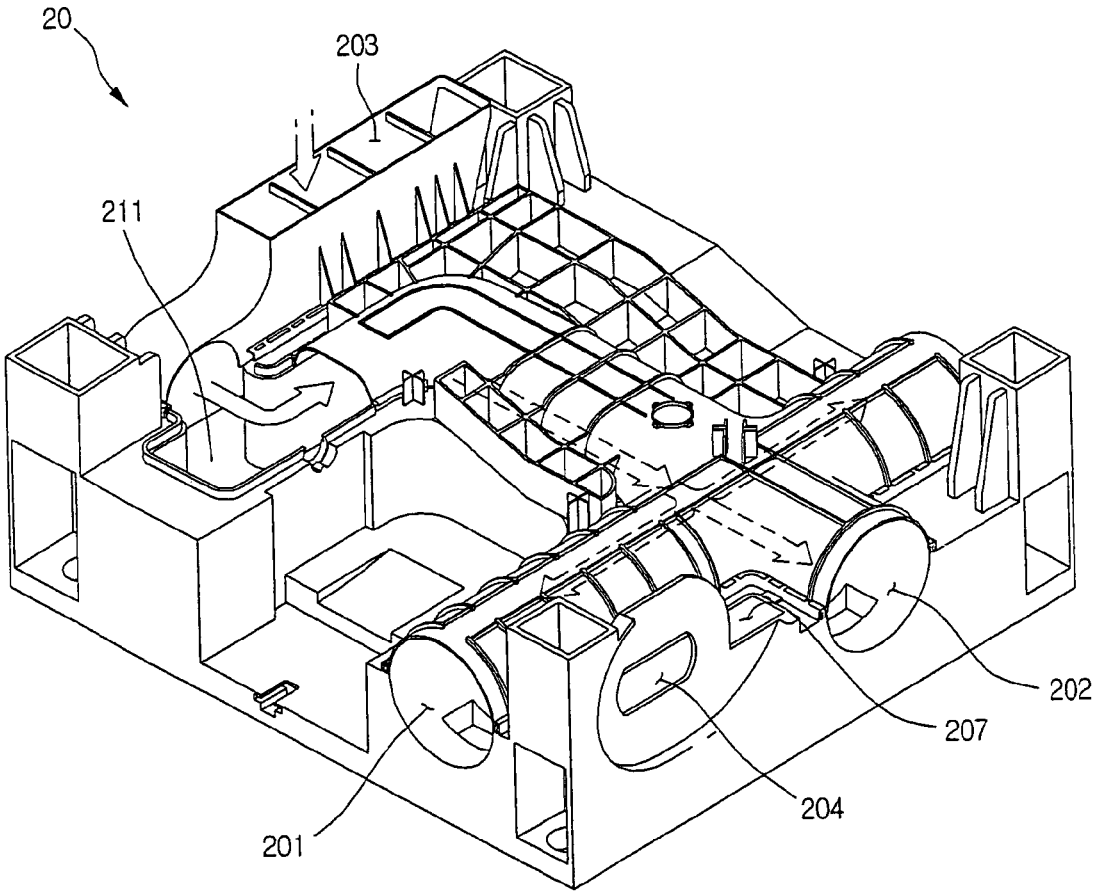
FIG. 6 is a perspective view showing airflow within a base according to the present invention.

FIG. 6 is a perspective view showing airflow within a base according to the present invention.

Referring to FIG. 6, as described above, the air that passes through the drying drum 14 passes through the lint filter installed in the front cover 111 to shed impurities in a first stage, and then descends through the drum connecting passage 203. Then, the air that descends through the drum connecting passage 203 moves to the blower entrance 206 formed at the end of the blower connecting portion 221*a*.

The air that moves to the blower entrance 206 is redirected by the blower installed in the blower compartment 211. The air that is redirected by the blower flows to the expanded passage portion 212. The flow direction of the air is redirected again at the expanded passage portion 212 to the main passage 213, and the air flows to the rear of the base 20. A portion of the air flowing through the main passage 213 branches off at the passage intersection 215 (where the main and sub passages 213 and 214 intersect) to the sub passages 214. The air flowing through the main and sub passages 213 and 214 flow through the rear exhaust port 202 and/or side exhaust port(s) 201 to be exhausted back to the outside. Here, the hot, moist air that exits the drying drum 14 cools (and a portion of the moisture in the air condenses) during the time it takes to flow from the drum connecting passage 203 to the exhaust ports 201 and 202. The condensed moisture accumulates in the condensation pans 214*a* recessed in the floors of the main and sub passages 213 and 214.

The outside air that flows into the rear of drying drum 14, that is, outside air with the same temperature and humidity of inside air, re-enters the drying drum 14 through the drying duct 17 through the outside air intake port 204 formed at the rear of the base 20.

Figure 7:
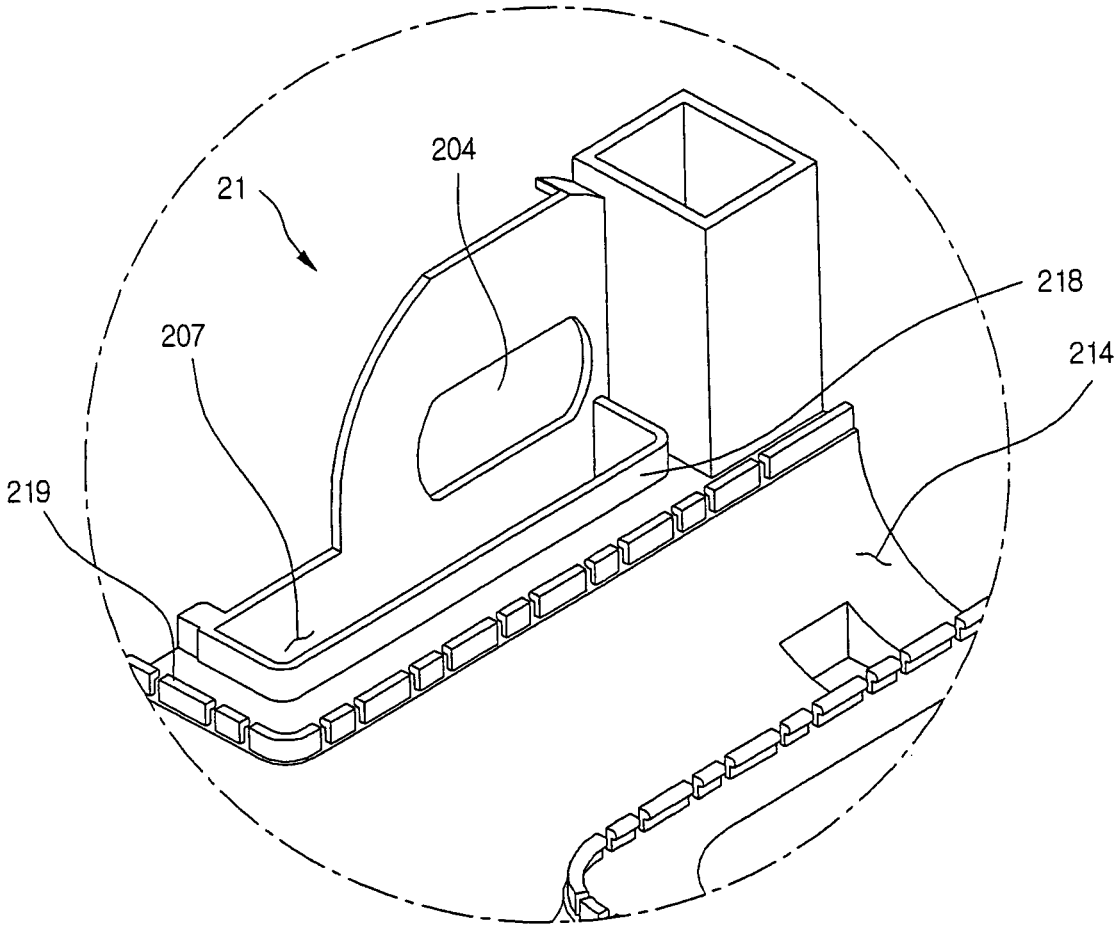
FIG. 7 is an enlarged perspective view of an impurity entry preventing structure in a dryer according to the present invention.

FIG. 7 is an enlarged perspective view of an impurity entry preventing structure in a dryer according to the present invention.

Referring to FIG. 7, as briefly addressed above, a lint entry preventing ledge 218 and a lint entry preventing slot 207 are formed to prevent impurities from entering through the outside air intake port 204.

More specifically, the air suctioned through the outside air intake port 204 is inner air inside the cabinet 11 of the dryer 10. However, the inner air entering through the outside air intake port 204 may mix with small quantities of hot, moist air that leaks through small gaps in the coupling regions between the base upper and lower portions 22 and 21. Also, lint that may escape from the drying drum 14 may mix with the air moving through the passages. However, due to the lint entry preventing ledge 218 that protrudes a predetermined height along the perimeter of the lint entry preventing slot 207, impurities escaping from a gap formed between the upper base 22 and the lower base 21 is prevented in a first stage. The air that is filtered in the first stage by the lint entry preventing ledge 218 is filtered again by the lint entry preventing slot 207.

In detail, impurities contained in outside air that enters through the outside air intake port 204 accumulates in the lint entry preventing slot 207, to reduce the impurities entering into the drying duct 17.

In further detail, the outside air that is suctioned through the outside air intake port 204 swirls in the lint entry preventing slot 207, so that the lint and other impurities contained in the air is deposited on the floor of the lint entry preventing slot 207. The outside air intake port 204 is formed to be higher than the floor of the lint entry preventing slot 207, to prevent the impurities deposited on the floor of the lint entry preventing slot 207 from easily entering through the outside air intake port 204.

Figure 8:
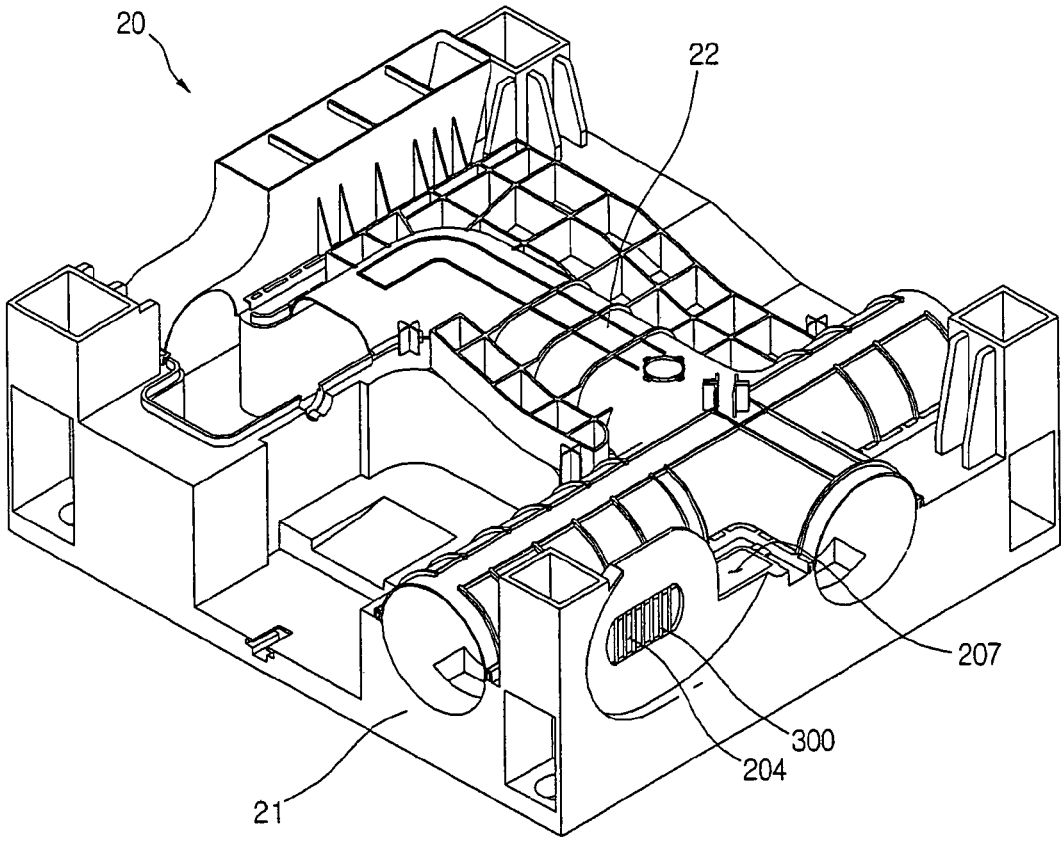
FIG. 8 is a perspective view of a base with an impurity entry preventing device installed on its outside air intake port according to the present invention.

FIG. 8 is a perspective view of a base with an impurity entry preventing device installed on its outside air intake port according to the present invention.

Referring to FIG. 8, a grated grill 300 window with a predetermined diameter is installed on the outside air intake port 204, to partition the latter into a plurality of small slots. Here, the bars of the grill 300 may be formed in a vertical or a horizontal direction. The distances between the grill 300 bars may be adjusted to effectively filter impurities. However, if the gaps between the bars are excessively narrow, suctioning force can decrease, and a load on the motor 15 can increase so that more energy is consumed. Therefore, an adequate gap should be formed.

In another embodiment of the grill 300, a net may be formed on the grill. Specifically, a grill that intersects in vertical and horizontal directions may be formed to filter small lint particles and other impurities in air suctioned through the outside air intake port 204.

The grill 300 may be integrally formed with the lower base 21 through plastic injection molding for the sake of favorable manufacturing process and cost.

In the above structure, air that is suctioned through the outside air intake port 204 is filtered of impurities in a first stage by the lint entry preventing ledge 218 and in a second stage by the lint entry preventing slot 207. The impurities are filtered in yet another stage by the grill 300, so that a filtering in three stages occurs.

Figure 9:
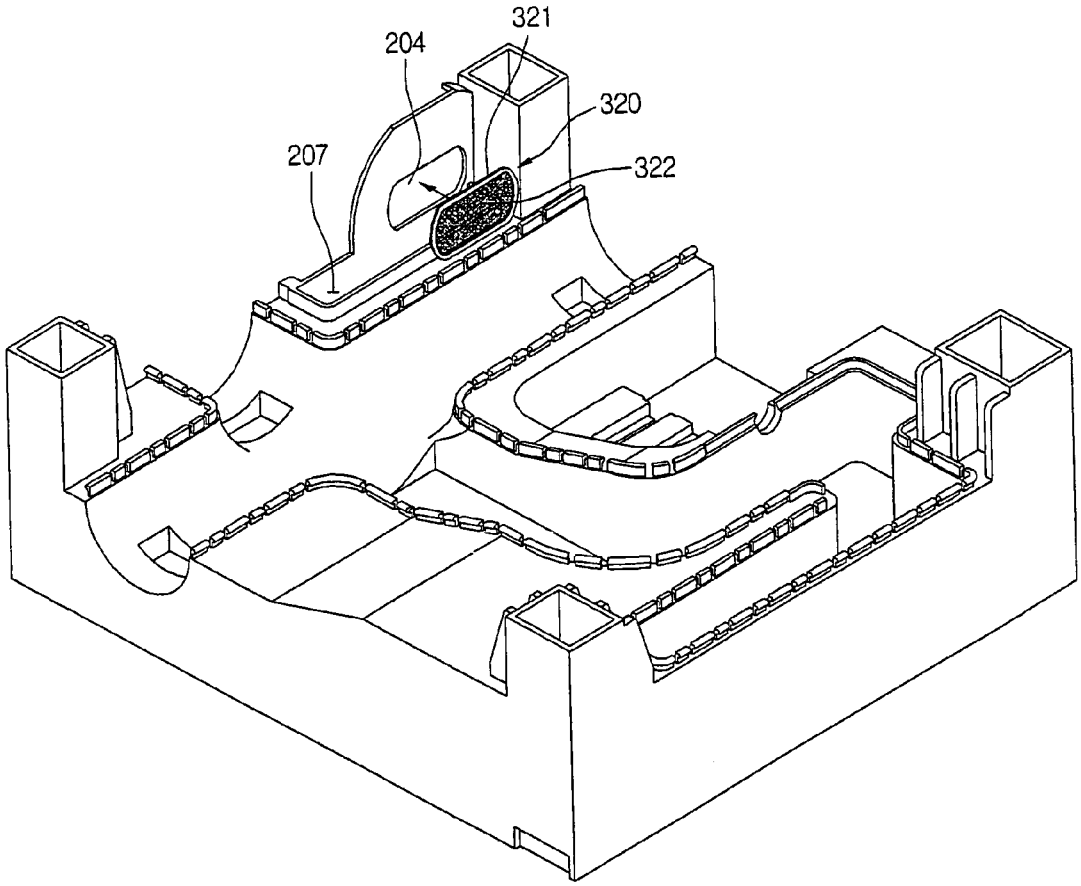
FIGS. 9 and 10 are perspective views of a lower base with an impurity entry preventing device installed on its outside air intake port according to another embodiment of the present invention.
Figure 10:
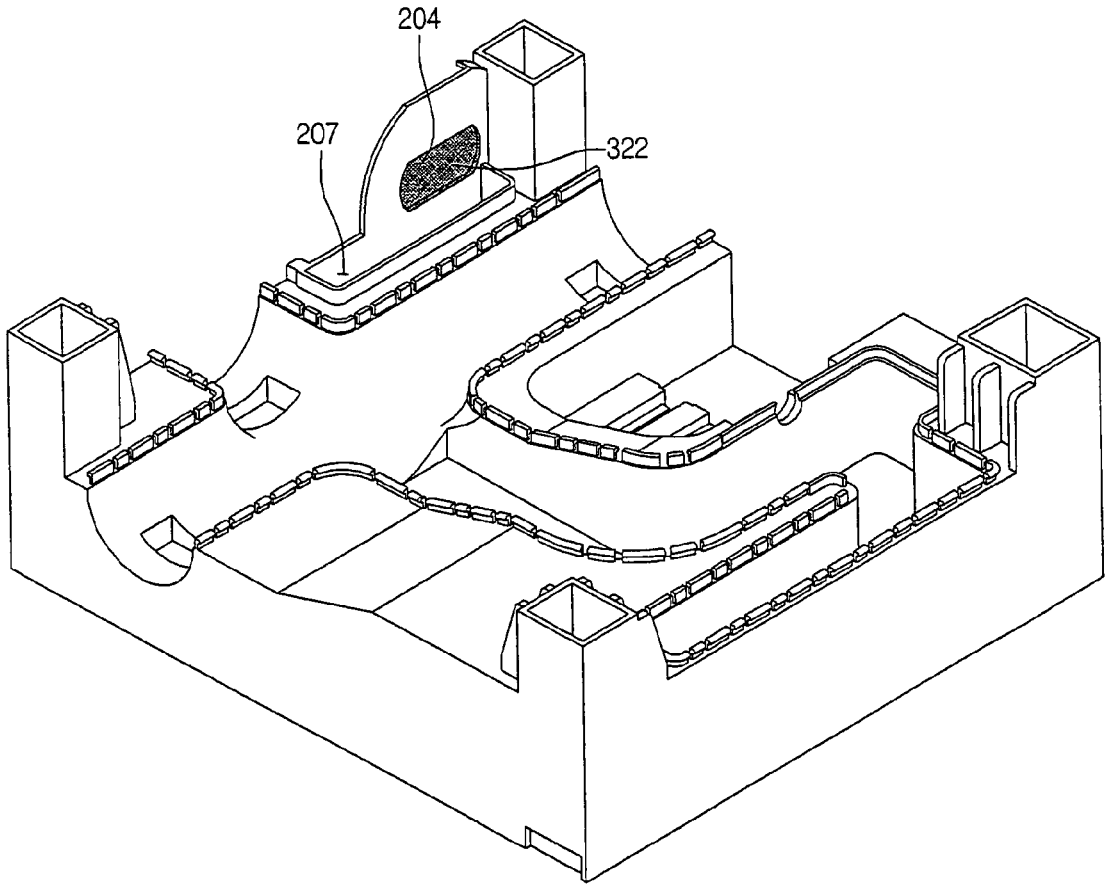

FIGS. 9 and 10 are perspective views of a lower base with an impurity entry preventing device installed on its outside air intake port according to another embodiment of the present invention.

Referring to FIG. 9, a base 20, of a dryer having an impurity entry preventing structure according to the present invention, includes an installed lint cap 320 for preventing impurities from passing through the outside air intake port 204.

Specifically, the lint cap 320 has a cap body 321 that is inserted into the outside air intake port 204, and a mesh 322 installed-within the cap body 321.

More specifically, the mesh 322 forms fine holes that filter lint and other impurities, preventing them from entering the outside air intake port 204. To remove impurities from the mesh 322, the lint cap 320 may be detached from the outside air intake port 204, and the impurities imbedded in the mesh 322 may be shaken or washed off with water. Also, in order to minimize deformation of the mesh 322 and increase its durability, it may be formed of a metal material.

Here, the cap body 321 and the mesh 322 may be integrally formed through insert injection molding. That is, the metal mesh 322 may be covered around its edge with a mold in the shape of the cap body 321, into which a plastic material is injected, thus forming the lint cap 320.

Referring to FIG. 10, the mesh 322 may be permanently fixed on the outside air intake port 204.

In other words, the mesh 322 may be fixed to the outside air intake port 204 during the injection molding of the lower base 21 so that it is integrally formed with the lower base 21.

In the above structure, the outside air entering the outside air intake port 204 can be effectively removed of small-sized impurities by the mesh 322.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A laundry dryer, comprising:

a cabinet;

a drying drum disposed within the cabinet;

a drying duct installed at an outer rear surface of the cabinet and having an outlet end thereof connected to an inlet into the drying drum;

a base disposed within the cabinet, the base including:

a lower base, including:

an air passage that receives exhaust air from the drying drum and discharges the exhaust air from the cabinet;

an air intake port that guides air from a space formed between the drying drum and the base within the cabinet into an inlet end of the drying duct; and a slot positioned upstream of the air intake port so as to separate impurities from air before it flows through the air intake port; and an upper base coupled to a top of the lower base so as to define an upper portion of the air passage; and a lint blocking member installed in the air intake port, wherein the lint blocking member filters impurities from air flowing through the air intake port that have not been separated by the slot provided with the lower base, wherein the slot is positioned immediately upstream of the air intake port such that impurities included in air from the space formed between the drying drum and the base within the cabinet fall into the slot before the air flows through the air intake port, through the drying duct and into the drum, wherein the slot is formed as a downward recess of predetermined depth in the lower base.

2. The laundry dryer according to claim 1, wherein the lint blocking member includes a cap body made of a plastic material and a mesh made of a metal material coupled within the cap body.

3. The laundry dryer according to claim 2, wherein the cap body and the mesh are coupled using insert injection.

4. The laundry dryer according to claim 1, wherein the lint blocking member is formed integral with the air intake port, or is detachably installed in the air intake port.

5. The laundry dryer according to claim 1, wherein the slot is formed at a position which is separated from the air passage through which air in the drying drum passes.

6. The laundry dryer according to claim 1, wherein the air intake port is formed at a position that is higher than the slot.

7. The laundry dryer according to claim 1, further comprising a lint entry preventing ledge that protrudes upward from an upper surface of the lower base, surrounding a perimeter of the slot.

8. The laundry dryer according to claim 1, wherein the lint blocking member comprises a lint cap including a metal mesh member.

9. The laundry dryer according to claim 8, wherein the mesh member is integrally formed through injection molding with the lower base.

* * * * *